US009384597B2

(12) United States Patent
Koch et al.

(10) Patent No.: US 9,384,597 B2
(45) Date of Patent: Jul. 5, 2016

(54) SYSTEM AND METHOD FOR CROWDSOURCING VEHICLE-RELATED ANALYTICS

(71) Applicant: Telogis, Inc., Aliso Viejo, CA (US)

(72) Inventors: Jason Mathew Koch, Huntington Beach, CA (US); Mark Sargent, Phoenix, AZ (US); Howard Jelinek, Laguna Beach, CA (US)

(73) Assignee: TELOGIS, INC., Aliso Viejo, CA (US)

( * ) Notice: Subject to any disclaimer, the term of this patent is extended or adjusted under 35 U.S.C. 154(b) by 0 days.

(21) Appl. No.: 14/201,485

(22) Filed: Mar. 7, 2014

(65) Prior Publication Data

US 2014/0277902 A1 Sep. 18, 2014

Related U.S. Application Data

(60) Provisional application No. 61/785,068, filed on Mar. 14, 2013, provisional application No. 61/785,523, filed on Mar. 14, 2013.

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01); *G07C 5/0825* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,809,437 | A | 9/1998 | Breed | |
| 6,154,658 | A | 11/2000 | Caci | |
| 6,263,268 | B1 | 7/2001 | Nathanson | |
| 6,301,531 | B1 * | 10/2001 | Pierro et al. | 701/31.4 |
| 6,429,773 | B1 | 8/2002 | Schuyler | |
| 6,604,033 | B1 | 8/2003 | Banet et al. | |
| 6,611,740 | B2 | 8/2003 | Lowrey et al. | |
| 6,732,031 | B1 | 5/2004 | Lightner et al. | |
| 6,920,381 | B2 | 7/2005 | Doherty et al. | |
| 7,123,164 | B2 | 10/2006 | Zoladek et al. | |
| 7,155,321 | B2 | 12/2006 | Bromley et al. | |
| 7,275,027 | B2 | 9/2007 | Sproule | |

(Continued)

FOREIGN PATENT DOCUMENTS

| | | | |
|---|---|---|---|
| EP | 1221588 | A1 | 7/2002 |
| EP | 2790414 | A1 | 10/2014 |
| WO | WO 2009/114626 | A2 | 9/2009 |

OTHER PUBLICATIONS

International Search Report and Written Opinion issue in application No. PCT/US2014/022078 on Jun. 25, 2014.

(Continued)

*Primary Examiner* — Thomas Tarcza
*Assistant Examiner* — Richard Goldman
(74) *Attorney, Agent, or Firm* — Knobbe, Martens, Olson & Bear LLP

(57) ABSTRACT

Currently vehicles typically include an engine computer that outputs diagnostic trouble codes (DTC) that are indicative of some fault condition in a vehicle. DTCs can tell a specific problem with a particular part such as that a cylinder in an engine is misfiring, but do not provide any indication as to the cause of the problem and do not propose any solutions for solving the problem. This disclosure advantageously describes systems that can analyze DTCs and other telematics data using crowdsourcing principles to recommend vehicle maintenance and other solutions.

21 Claims, 7 Drawing Sheets

(56) References Cited

U.S. PATENT DOCUMENTS

| | | | | |
|---|---|---|---|---|
| 7,373,225 | B1 * | 5/2008 | Grier et al. | 701/29.6 |
| 7,536,457 | B2 | 5/2009 | Miller | |
| 7,659,827 | B2 | 2/2010 | Gunderson et al. | |
| 7,804,426 | B2 | 9/2010 | Etcheson | |
| 7,912,641 | B2 | 3/2011 | Osentoski et al. | |
| 8,036,788 | B2 | 10/2011 | Breed | |
| 8,086,368 | B2 | 12/2011 | Petricoin, Jr. et al. | |
| 2002/0007225 | A1 * | 1/2002 | Costello et al. | 700/99 |
| 2002/0123832 | A1 | 9/2002 | Gotvall Per-Lage et al. | |
| 2003/0095038 | A1 | 5/2003 | Dix | |
| 2004/0039502 | A1 | 2/2004 | Wilson | |
| 2005/0171661 | A1 * | 8/2005 | Abdel-Malek et al. | 701/33 |
| 2006/0190162 | A1 | 8/2006 | Ampunan et al. | |
| 2007/0257781 | A1 | 11/2007 | Denson | |
| 2007/0257782 | A1 | 11/2007 | Etcheson | |
| 2007/0257804 | A1 | 11/2007 | Gunderson et al. | |
| 2007/0257815 | A1 | 11/2007 | Gunderson et al. | |
| 2007/0260361 | A1 | 11/2007 | Etcheson | |
| 2007/0260363 | A1 | 11/2007 | Miller | |
| 2007/0268158 | A1 | 11/2007 | Gunderson et al. | |
| 2007/0271014 | A1 | 11/2007 | Breed | |
| 2007/0271105 | A1 | 11/2007 | Gunderson et al. | |
| 2008/0043736 | A1 | 2/2008 | Stanley | |
| 2008/0049830 | A1 | 2/2008 | Richardson | |
| 2008/0114502 | A1 | 5/2008 | Breed et al. | |
| 2008/0147265 | A1 | 6/2008 | Breed | |
| 2008/0161989 | A1 | 7/2008 | Breed | |
| 2008/0269978 | A1 | 10/2008 | Shirole et al. | |
| 2008/0294690 | A1 * | 11/2008 | McClellan et al. | 707/104.1 |
| 2009/0051510 | A1 * | 2/2009 | Follmer et al. | 340/425.5 |
| 2009/0089134 | A1 * | 4/2009 | Uyeki | 705/9 |
| 2009/0112394 | A1 | 4/2009 | Lepejian et al. | |
| 2010/0057290 | A1 * | 3/2010 | Brillhart et al. | 701/33 |
| 2010/0087984 | A1 | 4/2010 | Joseph | |
| 2010/0161171 | A1 | 6/2010 | Valentine et al. | |
| 2010/0174439 | A1 | 7/2010 | Petricoin, Jr. et al. | |
| 2011/0046842 | A1 | 2/2011 | Smith | |
| 2011/0093159 | A1 | 4/2011 | Boling et al. | |
| 2011/0196572 | A1 * | 8/2011 | Tsuchikiri et al. | 701/35 |
| 2011/0225096 | A1 | 9/2011 | Cho et al. | |
| 2011/0238258 | A1 * | 9/2011 | Singh et al. | 701/33 |
| 2012/0089299 | A1 | 4/2012 | Breed | |
| 2012/0100509 | A1 | 4/2012 | Gunderson et al. | |
| 2012/0116609 | A1 * | 5/2012 | Jung et al. | 701/2 |
| 2012/0116631 | A1 * | 5/2012 | Lee et al. | 701/32.1 |
| 2013/0173028 | A1 | 7/2013 | Felty et al. | |
| 2013/0204484 | A1 * | 8/2013 | Ricci | 701/29.4 |
| 2013/0332023 | A1 * | 12/2013 | Bertosa et al. | 701/29.4 |
| 2014/0052328 | A1 * | 2/2014 | Nguyen et al. | 701/29.6 |
| 2014/0074345 | A1 * | 3/2014 | Gabay et al. | 701/31.4 |
| 2014/0180536 | A1 | 6/2014 | Nagata | |
| 2014/0310186 | A1 | 10/2014 | Ricci | |

OTHER PUBLICATIONS

Hess et al., "Prognostics, from the Need to Reality—from the Fleet Users and PHM System Designer/ Developers Perspectives" IEEEAC Paper #116, Updated Jan. 15, 2002.

International Search Report and Written Opinion of the International Searching Authority issued in International Application No. PCT/US2015/057215, mailed on Jan. 27, 2016.

* cited by examiner

SYSTEM AND METHOD FOR CROWDSOURCING VEHICLE-RELATED ANALYTICS

RELATED APPLICATIONS

This application claims the benefit of priority under 35 U.S.C. §119(e) of U.S. Provisional Patent Application No. 61/785,068, filed on Mar. 14, 2013, entitled "System and Method for Crowdsourcing Vehicle-Related Analytics," the disclosure of which is hereby incorporated by reference in its entirety. This application also claims the benefit of priority under 35 U.S.C. §119(e) of U.S. Provisional Patent Application No. 61/785,523, filed on Mar. 14, 2013, entitled "System for Performing Vehicle Diagnostic and Prognostic Analysis," the disclosure of which is hereby incorporated by reference in its entirety.

BACKGROUND

Vehicle and fleet management systems generally strive to maintain fleet vehicles in good operating condition. Vehicles undergo scheduled maintenance and other vehicles services in order to keep the vehicles in good operating condition, such as oil changes, brake pad replacement, timing belt replacements, and other services. These services can prevent or reduce the possibility of breakdowns or catastrophic failure to the vehicles. Breakdown or failure of vehicles during operation can result in unnecessary downtime and costs for the vehicles, delayed orders, accidents, and other problems.

SUMMARY

In certain embodiments, a method of programmatically diagnosing vehicle problems can include (under control of a hardware processor) identifying a diagnostic trouble code output by a vehicle, accessing community prognostics data associated with the diagnostic trouble code, where the community prognostics data are generated responsive to input associated with a plurality of vehicles, identifying a predicted diagnosis associated with the diagnostic trouble code from the community prognostics data, and outputting the predicted diagnosis for presentation to a user.

The method of the previous paragraph may have any subcombination of the following features: identifying the diagnostic trouble code can include programmatically identifying the diagnostic trouble code from telematics data associated with the vehicle; identifying the diagnostic trouble code can be performed substantially in real time; the method can further include identifying one or more of the following sensor data associated with the vehicle from the telematics data: speed, temperature, acceleration, G-force, rotation force as from a gyroscope, position, an odometer reading, a blown-out tire sensor reading, and a tire pressure reading; identifying the predicted diagnosis can be further responsive to said identifying one or more of the following sensor data; the method can also include obtaining the community prognostics data from a plurality of users; and this obtaining can include outputting a user interface configured to provide functionality for each of the users to associate the diagnostic trouble code with one or more selected predicted diagnoses, including the predicted diagnosis.

In certain embodiments, non-transitory physical computer storage includes instructions stored therein that, when executed by a hardware processor, can perform operations for programmatically diagnosing vehicle problems. These operations can include identifying a diagnostic trouble code output by a vehicle, accessing community prognostics data associated with the diagnostic trouble code, where the community prognostics data are generated responsive to input associated with a plurality of vehicles, identifying a predicted diagnosis associated with the diagnostic trouble code from the community prognostics data, and outputting the predicted diagnosis for presentation to a user.

The non-transitory physical computer storage of the previous paragraph can have any subcombination of the following features: identifying the diagnostic trouble code can include programmatically identifying the diagnostic trouble code from telematics data associated with the vehicle; identifying the diagnostic trouble code can be performed substantially in real time; the operations can further include identifying one or more of the following sensor data associated with the vehicle from the telematics data: speed, temperature, acceleration, G-force, rotation force as from a gyroscope, position, an odometer reading, a blown-out tire sensor reading, and a tire pressure reading; identifying the predicted diagnosis can be further responsive to said identifying one or more of the following sensor data; the operations can further include obtaining the community prognostics data from a plurality of users; and this obtaining can include outputting a user interface configured to provide functionality for each of the users to associate the diagnostic trouble code with one or more selected predicted diagnoses, including the predicted diagnosis.

In certain embodiments, a system for programmatically diagnosing vehicle problems can include a hardware processor that can identify a diagnostic trouble code output by a vehicle, access community prognostics data associated with the diagnostic trouble code, where the community prognostics data is generated responsive to input associated with a plurality of vehicles, identify a predicted diagnosis associated with the diagnostic trouble code from the community prognostics data, and output the predicted diagnosis for presentation to a user.

The system of the preceding paragraph can have any subcombination of the following features: the processor can identify the diagnostic trouble code by at least programmatically identifying the diagnostic trouble code from telematics data associated with the vehicle; the processor can further identify the diagnostic trouble code substantially in real time; the processor can further identify one or more of the following sensor data associated with the vehicle from the telematics data: speed, temperature, acceleration, G-force, rotation force as from a gyroscope, position, an odometer reading, a blown-out tire sensor reading, and a tire pressure reading; the processor can further identify the predicted diagnosis responsive to identifying the sensor data; and the processor can further obtain the community prognostics data from a plurality of users by at least outputting a user interface configured to provide functionality for each of the users to associate the diagnostic trouble code with one or more selected predicted diagnoses, including the predicted diagnosis.

For purposes of summarizing the disclosure, certain aspects, advantages and novel features of several embodiments have been described herein. It is to be understood that not necessarily all such advantages can be achieved in accordance with any particular embodiment of the embodiments disclosed herein. Thus, the embodiments disclosed herein can be embodied or carried out in a manner that achieves or optimizes one advantage or group of advantages as taught herein without necessarily achieving other advantages as can be taught or suggested herein.

BRIEF DESCRIPTION OF THE DRAWINGS

Throughout the drawings, reference numbers are re-used to indicate correspondence between referenced elements. The drawings are provided to illustrate embodiments of the inventions described herein and not to limit the scope thereof.

DETAILED DESCRIPTION

I. Introduction

Currently, vehicles typically include an engine computer that outputs diagnostic trouble codes (DTC) that are indicative of some fault condition in a vehicle. DTCs can tell a specific problem with a particular part, such as that a cylinder in an engine is misfiring, but do not provide any indication as to the cause of the problem and do not propose any solutions for solving the problem. This disclosure advantageously describes systems that can analyze DTCs and other telematics data using crowdsourcing principles to recommend vehicle maintenance and other solutions.

An example vehicle management system described herein can use crowdsourcing to predict maintenance events in the future based on current diagnostic and vehicle data. For example, a fleet manager may know that a particular DTC, code P2007, and a high torque condition on International trucks will likely cause a degraded head gasket resulting in an emergency breakdown in 3 months unless he replaces the head gasket. The vehicle management system can use insights like those known by this fleet manager together with others' insights and display to a user when they receive the corresponding vehicle data. Thus, a user who subsequently receives the DTC P2007 can be alerted to potential head gasket failure, and a maintenance work order can be created to inspect and/or replace the head gasket. This gathering and analysis of DTC trouble codes to present maintenance recommendations to users is one example of a prognostic crowdsourcing algorithm.

Advantageously, in certain embodiments, the vehicle management system can allow users to rate crowdsourcing predictions and optionally display the ratings to users as confidence indicators. When performing maintenance, the vehicle management system can examine the historical vehicle data for leading indicators, store the top potential leading indicators, and have users rate which ones most likely were leading indicators.

In another embodiment, the vehicle management system can implement a method for predicting road health issues such as potholes and degraded cracking based on remote sensor data from vehicles. Vehicles today with telematic equipment can easily obtain accelerometer based events such as g forces in 3 axes. This method can use a volume of sensor data to predict and pinpoint poor road quality or health. For example, if enough vehicles denote a heavy g-force incident (typically in the z axis) in the same location, most likely there is a bad pothole or degraded concrete cracking and or level change. Cities, public works, and highway maintenance entities can use this data to proactively identify the most troubling road health issues in their areas of responsibility.

II. Example Vehicle Management System

Figure 1:
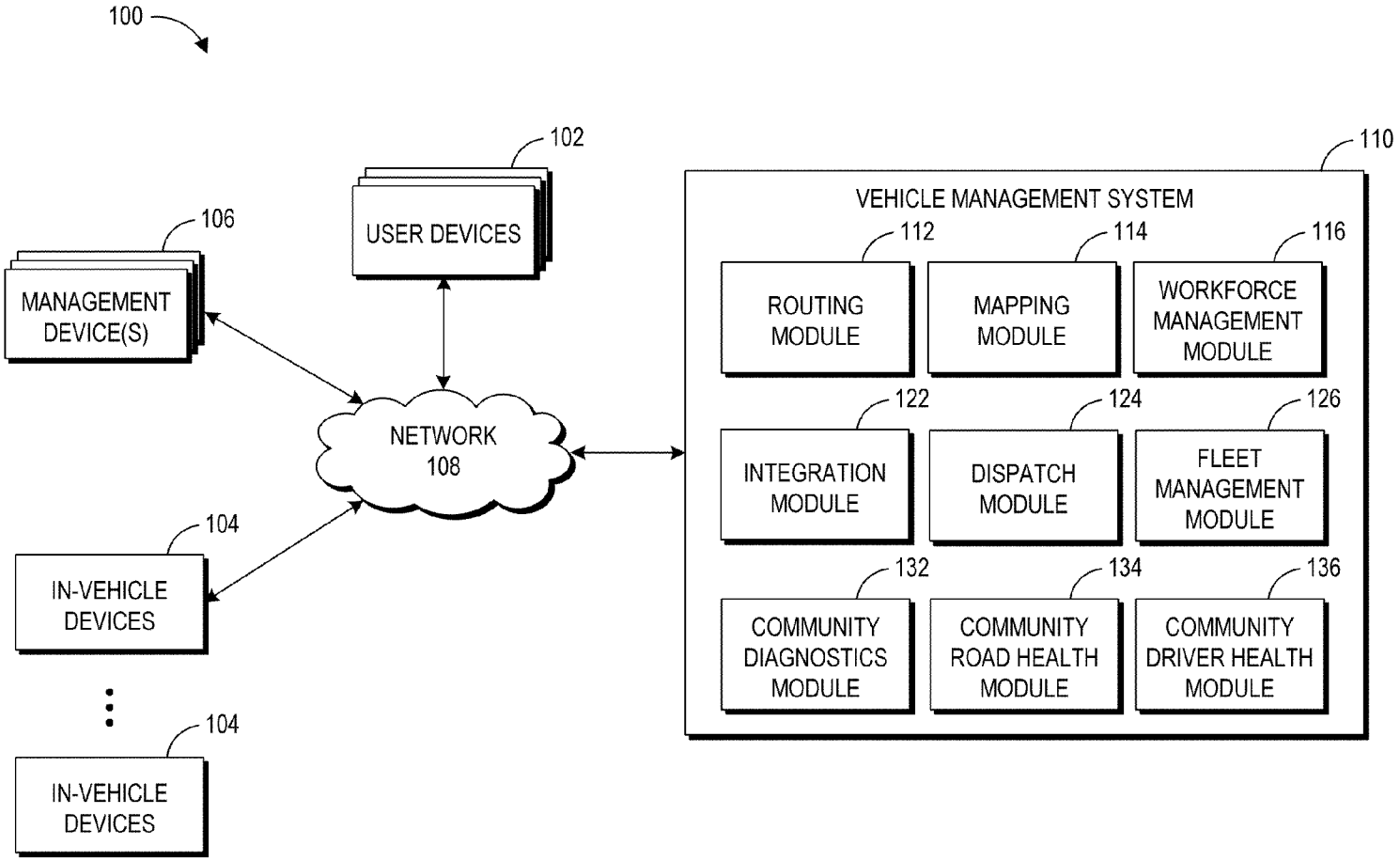
FIG. 1 depicts an embodiment of a computing environment that includes an example vehicle management system.

FIG. 1 illustrates an embodiment of a computing environment 100 for implementing crowdsourcing analytics using a vehicle management system 110. Among other features, the example vehicle management system 110 shown includes three crowdsourcing modules (132-136) that can analyze vehicle and/or driver data to provide vehicle diagnostics, road health information, and driver health information. Prior to describing the functionality of these crowdsourcing modules, the computing environment 100 and other aspects of the vehicle management system 110 will be described in detail.

In the computing environment 100, one or more in-vehicle devices 104 and management devices 140 communicate with the vehicle management system 110 over a network 108. The in-vehicle devices 104 can include computing devices installed in fleet vehicles. These devices 104 can include navigation functionality, routing functionality, and the like. The in-vehicle devices 104 can receive route information and other information from the vehicle management system 110. In addition, the in-vehicle devices 104 can report information to the vehicle management system 110, such as driver location, vehicle sensor data, vehicle status (e.g., maintenance, tire pressure, or the like), and so forth.

The illustrated network 108 may be a local area network (LAN), a wide area network (WAN), the Internet, combinations of the same, or the like. For ease of illustration, the vehicle management system 110 has been depicted as a centralized system or platform. However, in other implementations, at least some of the functionality of the vehicle management system 110 is implemented in other devices or in multiple servers or data centers. For example, the vehicle management system 110 can be implemented as software as a service (SaaS) in the cloud and may be located in multiple data centers around the world (or portion thereof). Other possible implementations of the vehicle management system 110 can include many more or fewer components than those shown in FIG. 1.

The management devices 140 can be computing devices used by dispatchers, fleet managers, administrators, or other users to manage different aspects of the vehicle management system 110. For example, a user of a management device 140 can access the vehicle management system 110 to generate routes, dispatch vehicles and drivers, and perform other individual vehicle or fleet management functions. With the management devices 140, users can access and monitor vehicle information obtained from one or more of the in-vehicle devices 104 by the vehicle management system 110. Such vehicle status information can include data on vehicle routes used, stops, speed, vehicle feature usage (such as power take-off device usage), driver behavior and performance, vehicle emissions, vehicle maintenance, energy usage, and the like. In some embodiments, the management devices 140 are in fixed locations, such as at a dispatch center. The management devices 140 can also be used by administrators in the field, and may include mobile devices, laptops, tablets, smartphones, personal digital assistants (PDAs), desktops, or the like.

The vehicle management system 110 can be implemented by one or more physical computing devices, such as servers. These servers can be physically co-located or can be geographically separate, for example, in different data centers. In one embodiment, the vehicle management system 110 is implemented as a cloud computing application. For instance, the vehicle management system 110 can be a cloud-implemented platform hosted in one or more virtual servers and/or physical servers accessible to users over the Internet or other network 108. In the depicted embodiment, the vehicle management system 110 includes a fleet management module 126, a mapping module 114, a telematics module (not shown), a routing module 112, a dispatch module 124, and an integration module 122. These components can, but need not, be integrated together on a common software or hardware platform.

The fleet management module 126 can include functionality for generating, rendering, or otherwise displaying one or more vehicle management user interfaces. The vehicle management user interfaces can include a map or list of vehicles that depicts symbols or other data representative of vehicles. In addition, the vehicle management user interfaces can optionally include a history timeline display. For example, in response to user selection of one or more of the vehicle symbols from the map or list, the vehicle management user interface can output one or more vehicle history timelines corresponding to the selected vehicle or vehicles. Although the fleet management module 126 generates the user interface, in certain embodiments the fleet management module 126 outputs the user interface to the management devices 140, which actually display the user interface and associated history timeline display 116. Thus, as used herein, the terms "output a user interface for presentation to a user," "presenting a user interface to a user," and the like, in addition to having their ordinary meaning, can also mean (among other things) transmitting user interface information over a network, such that a user device can actually display the user interface.

The fleet management module 126 can communicate with the mapping module 114 to obtain mapping data, which the fleet management module 126 can include in the vehicle management user interface. The mapping data can be compressed, transmitted, re-rendered, and displayed on the management user interface. Other data can also be overlaid to enhance the map and management layout. The mapping module 114 can be a geographic information system (GIS) in one embodiment. The fleet management module 126 can also access a telematics module (not shown) to obtain vehicle status data for inclusion in vehicle history displays. The telematics module can provide this vehicle status data based on telematics data obtained from the in-vehicle devices 104. The telematics data can include such data as location or speed information obtained using GPS or cellular tower triangulation (or other methods), vehicle sensor data, solid state inertial information, or any other data that can be obtained from a vehicle, its engine, or the like (including other sensors such as passenger seat sensors to detect the presence of passengers and so forth).

The routing module 112 can construct pre-dispatch or post-dispatch routes for vehicles based on any of a variety of routing algorithms, such as those disclosed in U.S. Publication No. 2010/0153005, filed Dec. 8, 2009, and entitled "System and Method for Efficient Routing on a Network in the Presence of Multiple-Edge Restrictions and Other Constraints," the disclosure of which is hereby incorporated by reference in its entirety. In addition, the routing module 110 can automatically select routes that take into account factors that affect energy usage using the techniques described in U.S. application Ser. No. 12/954,547, filed Nov. 24, 2010, and entitled "Vehicle Route Selection Based on Energy Usage," the disclosure of which is hereby incorporated by reference in its entirety.

The integration module 122 can facilitate integration of the vehicle management system 110 with other systems, such as fuel card systems, payroll systems, supply chain system, insurance systems, and the like. The dispatch module 124 can provide functionality for users of the management devices 140 to assign drivers and vehicles to routes selected by the routing module 110.

In the depicted embodiment, the vehicle management system 110 includes a community diagnostics module 132, a community health module 134, and a community driver health module 136. Each of these modules can be implemented in hardware and/or software. Each of these modules can use information obtained from a community of users to provide crowd-sourced data analytics related to vehicle fleet management. Examples of users that can provide input to the modules 132, 134 and 136 shown can include drivers of fleet vehicles, fleet managers, dispatchers, and other employees or owners of a vehicle fleet or any other user of the vehicle fleet management system 110. In an embodiment the community diagnostics module 132 provides functionality for users to evaluate diagnostics information and other telematics data obtained from vehicles so as to predict or prognosticate maintenance events for those vehicles.

Currently vehicles typically include an engine computer that outputs diagnostic trouble codes (DTC) that are indicative of some fault condition in a vehicle. DTCs can tell a specific problem with a particular part such as that a cylinder in an engine is misfiring, but do not provide any indication as to the cause of the problem and do not propose any solutions for solving the problem. Advantageously in certain embodiments the community diagnostics module 132 can analyze DTCs in the telematics data described above and can provide more targeted information to users based on DTCs detected in the telematics data. For instance, in certain embodiments a community diagnostics module 132 can provide one or more user interfaces that enable users to evaluate DTCs and map the DTCs to possible causes of problems and possible solutions for those problems. Because the community diagnostics module 132 can obtain this data from many users, the community diagnostics module 132 can aggregate this data and provide meaningful output that reflects the wisdom of the crowd or in other words that can distill the input of many users into one or more outputs that most likely correspond to accurate solutions and/or causes of problems for the DTCs.

More generally, the community diagnostics module 132 can operate on any type of data obtained in the telematics data including, for example, information about hard-braking or speeding by users among other things, including sensor input from any sensor in a vehicle and so on. The community road health module 134 can also leverage crowdsourcing techniques to analyze telematics data and output information about the condition or quality of roads upon which vehicles in a vehicle fleet travel. For instance, the telematics data may include data obtained from sensors like accelerometers or gyroscopes that measure acceleration or rotational forces of a vehicle or associated with a vehicle. The community road health module 134 can analyze the sensor data obtained from a plurality of vehicles to determine whether a particular road is rough or otherwise in need of repair. For instance, if multiple vehicles hit a certain pothole on a road and the accelerometer or other sensor in the vehicles may output large acceleration in the direction of up and down or the z-axis based on when the vehicle hits the pothole. As such, the community road health module 134 can determine that there is likely a pothole in the location corresponding to a plurality of vehicles having a spike in the acceleration data or the like.

The community road health module 134 may also implement additional complex algorithms beyond detecting spikes or peaks in acceleration data to detect rough or uneven road conditions (some examples of which are described below).

The output of the community road health module 134 may include warnings to drivers, dispatchers or navigators regarding road conditions. It may also include output to government agencies responsible for public works and safety and road conditions and thereby enable the government agencies to repair roads in a timely manner.

The community road health module 134 may also provide road-health data to the routing module 112 which can adjust routing and/or navigation based on the condition of various roads. For instance, a road may have a poor condition as computed by the road health module 134. The routing module 112 can take this road-health information into account and potentially route around the road or otherwise reduce the weight of that road in a particular routing algorithm. Likewise, the navigation capabilities of the in-vehicle devices 104 may be updated to take into account the road conditions and may notify drivers of roads that they may wish to avoid or of upcoming potholes so that drivers may know to potentially change lanes or slow down to avoid tire damage.

The computer driver health module 136 can perform similar crowdsourcing analysis to the community diagnostics module 132 and community road health module 134. In particular, the community driver health module 136 can perform crowdsourcing analysis to predict driver health situations that may benefit from remediation. As one example, a driver's driving behavior may change over course of time due to increased stress that the driver is experiencing due to work-related factors or personal-life factors. Aggressive driving behavior may be indicative that the stress of these factors is potentially going to cause the driver to get into an accident or have other problems. Thus, it may be useful to obtain information from the telematics data regarding driver health and use this information to predict driver conditions and recommend remediation for drivers such as time off, training, counseling, combinations of the same, or the like.

Further, the driver health of some or all of the drivers in a fleet or organization can be analyzed to observe the general pulse or health of the employees or contractors of a particular vehicle fleet management company so as to determine whether working conditions or other conditions are having potentially adverse effects on drivers. Vehicle fleet management or owners may use this information to consider whether to change policies to reduce driver stress or otherwise improve employee working conditions, among many other options for using this data.

As can be seen, the telematics data can be data-mined and analyzed by communities of users for a variety of reasons and it should be noted that the example features shown, including diagnostics, road health and driver health analysis, are merely examples of uses for community analysis of telematics data. Other examples include customer health where telematics data can be used to determine customer satisfaction as will be described in greater detail below.

In some embodiments, the vehicle management system 110 can also electronically tap into data sources other than telematics to supplement crowdsourced data and for shop management purposes. Data from non-telematics sources can be used by the community diagnostics module 132 to supplement maintenance data obtained from crowdsourcing. For example, diagnostic DTC code data and associated maintenance records of what maintenance was actually performed can be obtained from a vehicle maintenance shop. This non-telematics data can be combined with the crowdsourcing data to increase the accuracy of the crowdsourcing data, or may be displayed together with (but separate from) the crowdsourcing data. This non-telematics maintenance data obtained from a vehicle maintenance shop (e.g., including electronic reporting tools such as SnapOn™ technician tools) can therefore increase the accuracy of crowdsourcing maintenance predictions.

III. Example Community Diagnostics Process

Figure 2:
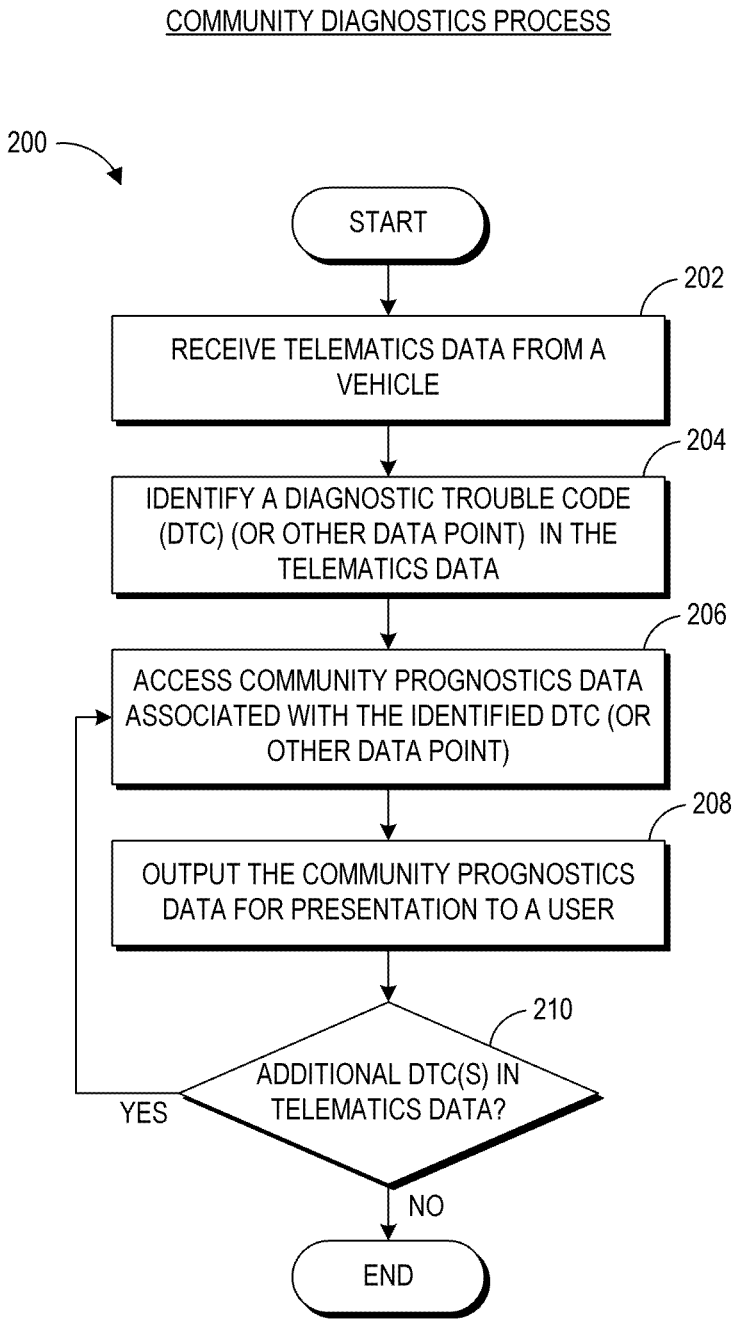
FIG. 2 depicts an embodiment of a community diagnostics process.

Turning to FIG. 2, an embodiment of a community diagnostics process 200 is shown. The community diagnostics process 200 may be implemented by the vehicle management system 110, and in particular, by the community diagnostics module 132. Accordingly, for convenience the process 200 will be described as being implemented by the community diagnostics module 132, although it should be understood that any machine (such as a computer having one or more processors) could implement the process 200. Advantageously, in certain embodiments the community diagnostics process 200 provides diagnostics for diagnostic trouble codes or other telematics data obtained from a vehicle so as to assist with troubleshooting problems in a vehicle or potential problems in a vehicle.

At block 202 of the process 200, the community diagnostics module 132 receives telematics data from a vehicle. The telematics data may be obtained by the diagnostics module 132 from a database stored by the vehicle management system 110 or directly from the vehicle in real time. At block 204, the community diagnostics module 132 identifies a diagnostic trouble code DTC or other data point in the telematics data. DTCs are described above and can include information that indicates potential problems in a vehicle. Other telematics data points that the diagnostics module 132 can identify can include such things as any sensor data such as speed, temperature, acceleration, G-forces, rotation forces as from a gyroscope, position, odometer reading and the like, as well as blown-out tire sensor readings, tire pressure readings, or other similar parameters.

Further, the data points identified by the diagnostics module 132 can include such things as audio recordings that may be obtained by a microphone and one or more processors in the vehicle. In some embodiments, there may be a gateway device or other computing device in the vehicle that can process the audio data and output an indication of what the audio data includes, which may be compressed or a summarized version of the audio data. The gateway device may, for instance, output a message that engine knocking has been detected based on analysis of the audio data obtained from a microphone installed in the engine. More generally, the telematics data may include any information obtained from the vehicle whether through sensors in the vehicle, the engine computer, or any other electronic device in the vehicle, including devices that are in a cab or a trailer that is connected to the vehicle.

At block 206, the diagnostics module 132 accesses community prognostics data associated with the identified DTC or other data point(s) in order to identify the cause and/or solution for the identified DTC or other data point. The community prognostics data may be stored in a database and may include information obtained from a plurality of users such as drivers, dispatchers, fleet managers or other users as described above. The community prognostics data is an example of crowdsourcing data.

As will be described in greater detail below with respect to FIGS. 5 and 6, the community diagnostics module 132 can gather community prognostics data by providing users with access to a user interface or the like that enables users to input such data. For instance, such a user interface could enable users to make comments on DTCs or other telematics data and to filter, sort, or otherwise rank such comments to obtain likely problems associated with the DTCs as well as likely solutions. For example, one DTC described above, P2007, may be indicative of potential head-gasket failure in a certain brand of truck if this code is also coupled with high torque conditions. The likelihood of head-gasket failure is not specified by the DTC itself; rather, DTC P2007 includes the description "intake manifold runner control stuck closed," which does not provide any indication of potential head-gasket failure at all. However, other drivers, mechanics, dispatchers, or fleet managers may know (e.g., based on their past experience) that this DTC can result in the head-gasket failure condition and can, therefore, indicate such using the features of the diagnostics module 132. The community diagnostics module 132 can store this potential outcome of head-gasket failure, as specified by one or more users, together with data representing the diagnostic trouble code P2007 in the community prognostics data store.

In one embodiment, any solution or diagnosis offered up by users may be stored together with a DTC or other data point in the community prognostics data store. The more users that agree with the proposed solution or diagnosis associated with the DTC or other data point (e.g., by rating the proposed solution), the higher rated the proposed solution or diagnosis may be. Generally, crowd-sourced solutions or diagnoses may be ranked or otherwise scored to reflect the amount of users that agree with the proposed solutions or diagnoses. Such rankings or scores can be used to subsequently sort the solutions or diagnoses associated with DTCs or other data points.

At block 208, the diagnostics module 132 can output at least a subset of the community prognostics data accessed at block 206 for presentation to a user. For example, the diagnostics module 132 can output a most highly ranked subset of the solutions or diagnoses associated with the DTCs or data points for output to a user. The output can be provided in a user interface to any of the users described herein. For example, the output can be provided directly to drivers so that drivers can be informed that they need to bring their vehicles in for maintenance, to dispatchers so the dispatchers can inform drivers that they need to schedule maintenance on their vehicles, to fleet managers, or the like.

As described above, in addition to DTCs, data points can be identified in the telematics data and can be analyzed together with the DTCs to determine whether a problem is about to occur. For example, in the example described above with DTC P2007, it was mentioned that such a DTC combined with a high-torque condition, which may be measured by an engine sensor, may result in likely head-gasket failure. If a vehicle is detected to have both DTC P2007 and the high-torque condition, then the prognostics data can be output for presentation to the user that indicates the potential problem of a likely head-gasket failure. Alternatively, if the high-torque condition is not present in the vehicle, the prognostics data regarding head gasket failure may not be output to a user. Accordingly, an alert can be provided to one or more users when a DTC and one or more other data points are detected, or alternatively, just when a DTC or just when a data point other than a DTC is detected.

At block 210, it is determined whether any additional DTCs (or other data points) are in the telematics data. If so, the process 200 loops back to block 206 to analyze the additional DTCs (or other data points). Otherwise, the process 200 ends.

The process 200 can be implemented as an automatic process in certain embodiments because the community prognostics data may be obtained in a previous step or in parallel with the process 200. For example, community prognostics data can be updated continually or periodically as users continue to add comments about DTCs or other data points. The community diagnostics process 200 can access this updated prognostics data (e.g., at block 206) as it is updated over time. In another embodiment, the features of the process 200 can also be used to perform manual checkups on DTCs or other data points. For instance, an interested user may wish to know what community diagnostics or prognostics data is available for a particular DTC or data point. The user may perform a search using a user interface that can cause the process 200 to access the prognostics data and output results accordingly.

IV. Example Community Road Health Process

Figure 3:
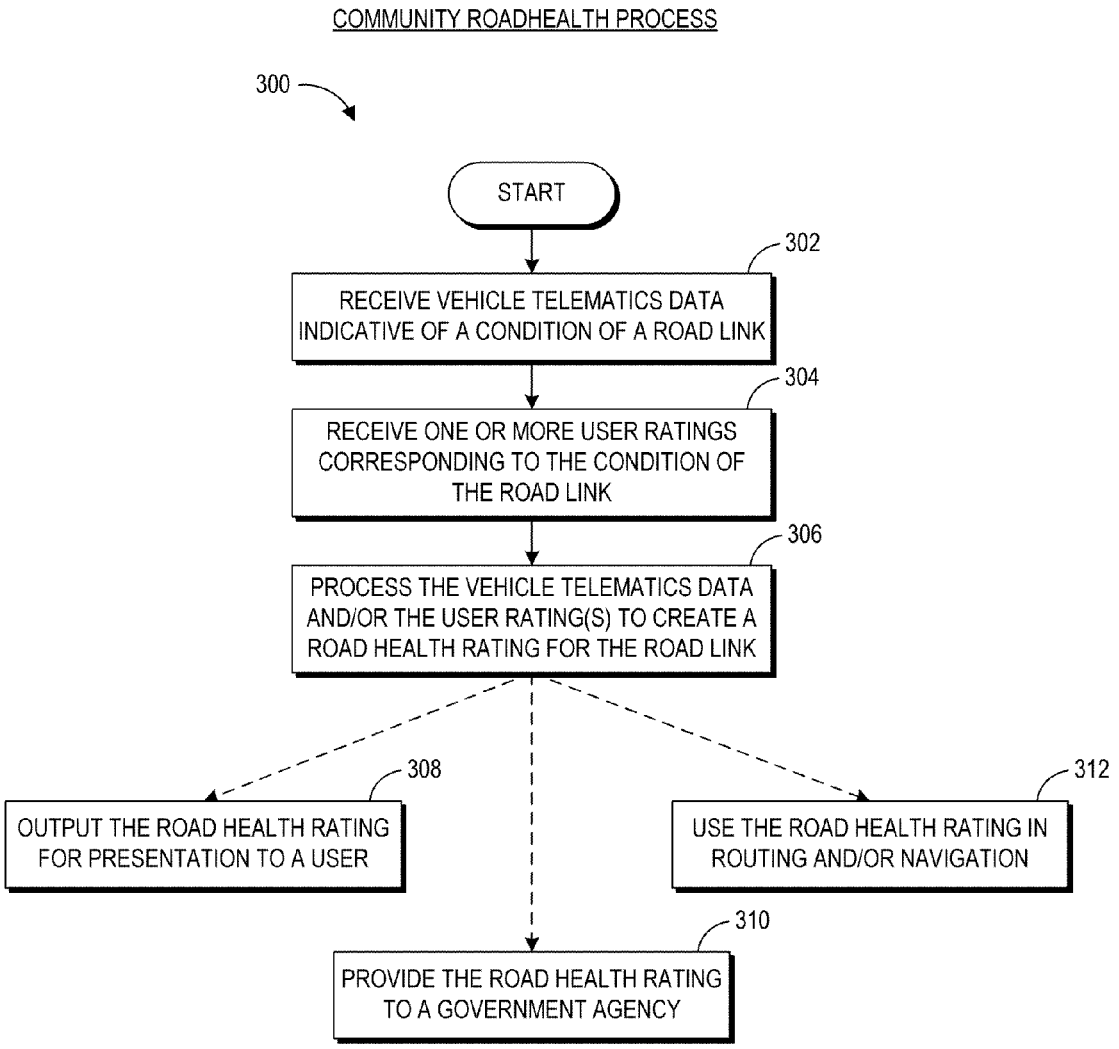
FIG. 3 depicts an embodiment of a community roadhealth process.

Turning to FIG. 3, an embodiment of a community road health process 300 is shown. The community road health process 300 can be implemented by the vehicle management system 110, and in particular, by the community road health module 134. For convenience the process 300 will be described herein as being implemented by the road health module 134, although should be understood that the process 300 may be implemented by any machine including a computer having one or more processors. Advantageously, in certain embodiments. the community road health process 300 uses data obtained from a plurality of vehicles and/or users to ascertain the health or condition of roads upon which those vehicles travel.

At block 302 of the process 300, the road health module 134 receives vehicle telematics data indicative of a condition of a road link. The telematics data may come from one or more vehicles or a plurality of vehicles. The road link can be any portion of a road, such as a road section between any two consecutive intersections, or an entire road from its starting point to the point at which it terminates. Alternatively, the road link may be a geographically-demarcated portion of a road, such as a portion of a road that extends through an entire town, city, county or state or other geographic boundary, or sub-portion thereof (such as a district within a town).

The telematics data can include any of the telematics data described above. For instance, in one embodiment the telematics data includes accelerometer data from one or more accelerometers included in each vehicle (or similar such devices such as gyroscopes or the like). This telematics data may be indicative of a condition of a road because as the vehicle travels over a road, the accelerometer (or similar such device) can respond to vibrations of the vehicle over the road. When the road is rough or has potholes or other cracks, the accelerometer may detect this unevenness and output a signal that has a magnitude corresponding to the unevenness. The greater the roughness of the road, the greater the magnitude that the accelerometer output may be. In fact, when the vehicle is over a flat surface or nearly flat surface the accelerometer may detect very little vibration at all, except perhaps due to the motion of the vehicle itself.

As mentioned above, accelerometers are not the only sensors that can be used to detect road conditions. Other sensors such as tire sensors can detect road conditions as well, alone or coupled with accelerometers or other such devices. For instance, a tire blowout sensor may be available that may be in communication with one or more tires of a vehicle such as a semi truck. If a tire blows out, the tire blowout sensor can provide a signal that may be transmitted to the vehicle management system 110. This signal may indicate that the road was uneven and, therefore, potentially caused the blowout. When coupled with accelerometer data indicative of a rough surface, a tire blowout sensor can increase the confidence that an actual pothole or uneven surface was detected and that the blowout was not due to some random occurrence. Like in the process 200, the process 300 can access the vehicle telematics data from a database of stored telematics data or may receive the telematics data in real time from one or more vehicles.

At block 304, the road health module 134 receives one or more user ratings corresponding to the condition of the road link. The user ratings may be received from a database that is in communication with one or more user interfaces that provide users with the opportunity to rate roads or road links. These users can be any of the users described above, including drivers. Drivers, when driving upon certain roads, may notice that a particular section of the road is particularly rough or uneven (or that a particular section of the road is smooth and even). Drivers can provide such information through a user interface on the in-vehicle device 104 to the vehicle management system 110.

The information provided by the users can be in the form of ratings such as one to five-star ratings, up or down ratings, or other types of ratings. In one embodiment, the in-vehicle devices 104 provide hands-free options for inputting this ratings data. For instance, the in-vehicle devices 104 may include a voice-activated system that can detect voice input by a user and can transcribe this information and send it to the vehicle management system 100. Such functionality may enable a driver to dictate the condition of a road while driving by saying, for instance, "This road is uneven" or "I just hit a pothole." The in-vehicle device 104 can receive this audio through a microphone and can transcribe it into text and detect the text as corresponding to a pothole or unevenness, combine such data with the position data of the vehicle, and provide this information to the vehicle management system 110 so that the position of the pothole can be stored.

The remainder of the process 300 can use both the telematics data and user road ratings to evaluate road health. However, it should be noted that either block 302 or block 304 may be omitted from the process 300, such that either telematics data or driver ratings data is solely used to evaluate road health.

At block 306, the road health module 134 processes the vehicle telematics data and/or the user ratings to create a road health rating for the road link. For instance, if the telematics data indicates that a pothole was detected in a particular location and/or if the user ratings indicate that a pothole or other unevenness of a road was present, then the road health module 134 can output a relatively low road-health rating for the road. Conversely, if no such data is available or if such data indicates that the road condition is good for a particular road link, the road health module 134 can output a relatively higher road-health rating for that road link at block 306. In some embodiments, if no data is available, either from telematics data or user ratings for a road link, then no road-health rating is given for that particular road. Alternatively, an average road-health rating (or a good road-health rating) is given for that particular road.

Road health ratings may be on any scale, such as a one-to-five star rating scale, a 0 to 100 points scale, or the like. Road health ratings may also be represented by symbols other than numbers, such as colors (e.g., with green representing a healthy road, red representing a poor road, and yellow representing a fair road). Any of the scores or rankings described herein can be inverted, such that a low score indicates a high degree of health for a road and vice versa. However, for convenience, this specification typically refers to a high score as indicating good road health and a low score as indicating poor road health.

There are many techniques for analyzing the telematics data that may be employed by the road health module 134 to ascertain the road health of a particular road link. These techniques can include time-series analysis techniques and signal-processing techniques, among others. For instance, signal-processing techniques can include analyzing accelerometer data or other sensor data in the time domain to detect peaks in the magnitude of the accelerometer data. Peaks in magnitude can be indicative of potholes or other uneven road conditions. The magnitude of these peaks can be used by the road health module 134 to assess a rating or score for the road link. If the peaks are relatively higher, the road health rating may be considered relatively lower by community road health module 134.

In addition to time-domain signal processing techniques, frequency-domain techniques may be also employed by the road health module 134. For instance, data obtained from an accelerometer or other sensor may be divided into blocks of samples, and the fast Fourier transform (FFT) may be applied to those blocks of samples to obtain a frequency-domain representation of the sensor data. The road health module 134 can obtain the magnitude or power spectrum of the frequency domain representation and analyze the energy or power of the magnitude or power spectrum. Greater signal energy or power can be indicative of uneven road surfaces or potholes, whereas lower energy or power in the signal in the frequency domain may be indicative of more even roads and surfaces.

In one embodiment, the road health module 134 may normalize the time-domain and/or frequency-domain information based on a variety of factors. One factor that can be used to normalize the data is the weight of the vehicle from which the data is obtained. Vehicles that weigh more may, by virtue of their weight, have a damping effect on the accelerometer data, whereas lighter vehicles may be more responsive to unevenness in the roads. A lighter vehicle hitting a pothole may have a greater vertical displacement, for instance, than a very heavy vehicle. Normalization based on weight can also depend on the location of sensors in a vehicle. If an accelerometer is placed in or around the cab of a semi trailer truck, for instance, the vibration of the accelerometer may be less dependent on the overall weight of the truck than if the accelerometer were to be placed in or around the trailer, which may have a variable weight due to its contents. Accordingly, the total weight of the vehicle may or may not be used to normalize accelerometer data; rather, the weight of the cab may be used to normalize accelerometer data.

In another embodiment, the road health module 134 performs also normalization based on the type of vehicle. A semi-truck, for instance, tends to weigh more than a light-duty truck, and the road health module 134 may apply a normalization factor to data from one or both of such trucks based on their truck type, rather than an exact weight of each truck. In another embodiment, the road health module 134 performs normalization based on the brand or model of a vehicle. Some vehicles have more tightly tuned suspensions than others, and some suspensions may therefore provide more damping effects than other suspensions for equally weighted vehicles. The road health module 134 can normalize data from different types of vehicles having different types of suspensions to account for different damping effects. Moreover, the road health module 134 can use any subset of the vehicle-specific normalization factors described herein to normalize accelerometer data or other sensor data used to analyze road-health conditions, including vehicle weight, vehicle type, vehicle brand, vehicle model, suspension type, and so on.

Further, in order to more accurately compare the road health of different road links, the road health module 134 can perform normalization of the data based on the characteristics of road links. For instance, normalization may be performed based on road link length. Intuitively, a road length that is 100 meters and has five potholes may be considered to have lower road health than a road link that is 1 kilometer with five potholes. The potholes per kilometer are much greater for the first road link than the second road link. Thus, in one embodiment, the road health module 134 can calculate the number of potholes detected divided by the length of the road link to normalize the road health score. Or, in another embodiment, the road health module 134 first calculates a preliminary road health score based on the number of potholes (or some quantity of detected road roughness), which may or may not be equal to the number of potholes. This preliminary road health score can take into account vehicle-specific normalization factors as described above. Then the road health module 134 can divide the preliminary road health score by the length of the road to normalize the preliminary road health score for road-specific factors to produce a normalized road health rating.

In alternative embodiments, individual potholes are not detected by the road health module 134; rather, the energy of the spectral data obtained from the accelerometer or other sensor can be divided by the length of road link to develop a preliminary road health score. For instance, the road-health score may be obtained by summing the energy in each frequency bin of the output FFT from an accelerometer for a particular road link. This score can then be normalized using vehicle- and/or road-specific factors as described above. If there are multiple sample blocks of data obtained for a particular road link, then the energy value for each sample block of data may be summed within the time that the road link was traversed by the vehicle. This total sum of energy may then be divided by the length of the road length and to result in an initial road health score. This value may be considered the road-health score or may be mapped onto another scale that is the road-health score, before or after normalization. As described above, normalized road health scores may be combined with other scores such as user ratings and/or time-domain scores to come up with an overall health rating for a road.

Further, it should be noted that in some embodiments, the road-health data is updated dynamically as road-health conditions change and as telematics data is received from a plurality of vehicles. For most roads, the road-health condition may change slowly over time as vehicles slowly worsen due to weather or other conditions. However, for some roads the road-health condition may change dramatically. For instance, if construction is performed on a road, the road may become very uneven and, therefore, the road-health condition may be updated and changed very quickly. Averaging techniques may be used by the road health module 134 to average current road-health scores with previous road-health scores, including exponential averaging or linear averaging techniques that de-weight older scores over time.

From block 306, the process 300 bifurcates into blocks 308, 310 and 312. Dashed lines from the block 306 to blocks 308, 310 and 312 indicate that any of these paths are optional and that one or more of blocks 308 through 312 may be implemented. At block 308, the road-health rating is output by the road health module 134 for presentation to a user. The road-health rating may be output on a display for any of the users described herein. For example, the road-health rating may be output to a driver on a navigation display in the in-vehicle device of a vehicle operated by the driver. The driver may use the road-health rating to determine whether to traverse a particular road in a route recommended by the navigation device. It may be that a driver feels that a road is too rough to travel and, therefore, chooses to modify his or her route. This may be particularly so if the driver is carrying fragile cargo and wishes to have a less-rough route. In addition, another user that the road-health rating can be displayed to can be a dispatcher. A dispatcher may notice that a particularly rough road is coming up based on the road-health rating for a particular driver and may reroute the vehicle's route based on the road-health rating.

At block 310, the road-health rating can be provided to a government agency such as a Public Works Department or the like. The road health module 134 can electronically transmit road-health ratings for a plurality of roads in a geographic information systems (GIS) package or the like to a government agency for the purpose of the government agency using such information to improve road conditions. In another embodiment, the road health module 134, the vehicle management system 110, and/or the in-vehicle devices can be operated or implemented by the government agency itself and used thereby to improve road conditions. In an embodiment, the road health module 134 provides forecasting software that enables the government agency or an operator of the vehicle management system 110 to forecast which roads may benefit from repair based on the measured road-health conditions.

At block 312, the road-health rating can be used in routing and/or navigation. Road-health ratings for a plurality of road links can be used as an input to a routing algorithm or optimization algorithm of the vehicle management system 110 in part to determine routes for vehicles. The road health score may be one factor among several factors evaluated by the routing algorithm. In one embodiment, a dispatcher can increase the weighting applied to this factor of road-health rating based on the type of cargo or vehicle that is subject to the route. Fragile cargo may be more sensitive to certain routes and, therefore, it can be useful to emphasize the road health rating in routing a vehicle with fragile cargo. The example uses described herein for the road-health rating of a particular road link are merely examples and are not meant to be an exhaustive list of possible uses for the road-health rating.

V. Example Community Driver Health Process

Figure 4:
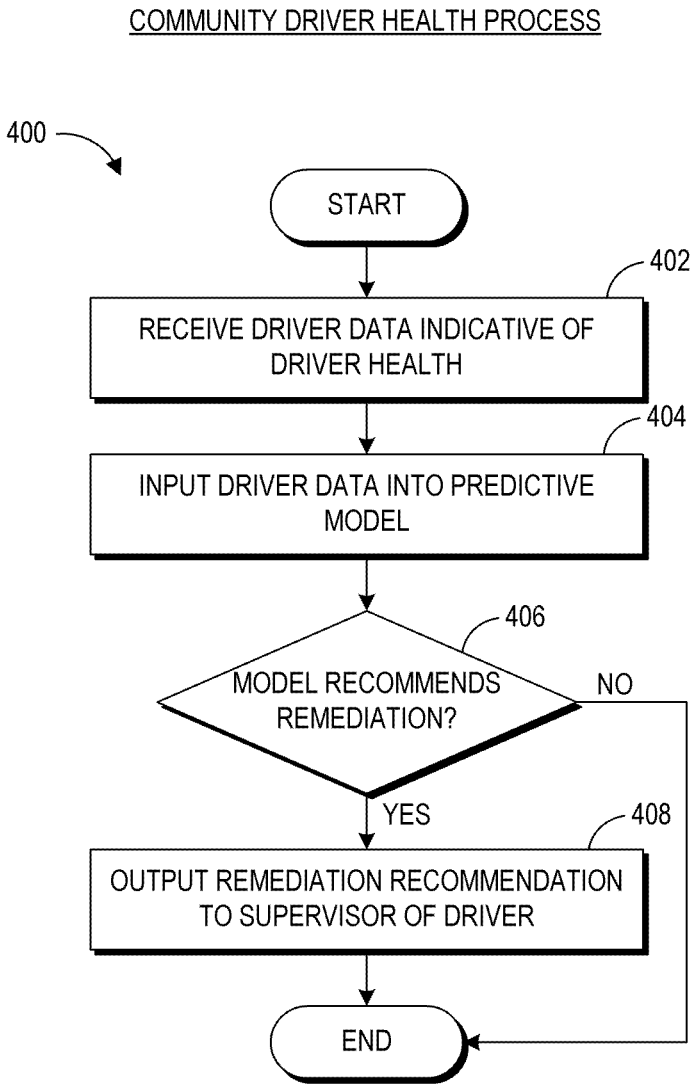
FIG. 4 depicts an embodiment of a community driver health process.

Turning to FIG. 4, an embodiment of a community driver health process 400 is shown. The community driver health process 400 may be implemented by the vehicle management system 110 and in particular by the community driver health module 136 described above. Like the processes 200 and 300, the process 400 is described as being implemented by the community driver health module 136, although it should be understood that any machine including a computer with one or more processors could implement the process 400.

Advantageously, in certain embodiments, the process 400 can apply the principles of crowdsourcing as described herein to predict potential driver health issues that may benefit from remediation. As an example, a driver may have stressors outside of work in his or her personal life that begin to interfere with work, and it can be useful to predict those situations so that Human Resource (HR) personnel or other management can remediate such stress if possible. The process 400 can automatically predict at least some driver health situations where remediation may be recommended.

Referring to FIG. 4, at block 402, the driver health module 136 receives data that may be indicative of a driver's health, whether physical, emotional, or mental. This data may be obtained from telematics data and/or from workforce management data collected by the workforce management module 116. Examples of driver data that may be indicative of a driver's health can include telematics data related to driving behavior, such as whether a driver has become a more aggressive driver recently, for example, by increasing speeding, hard-braking or the like. In addition, driver data indicative of driver health can include data about accidents that a driver has been involved with. When an accident occurs, an airbag sensor may detect that an airbag is deployed, and this data from the airbag sensor can be supplied in the telematics data to the vehicle management system 110 for analysis by the driver health module 136. The driver health module 136 can analyze this data to determine whether an accident has occurred. If an accident has occurred, or if the driver's driving behavior has changed recently, the driver health module 136 can infer that the driver may be experiencing stress or other health issues and may benefit from remediation.

Non-driving factors that can be accessed by the workforce management module 116 can include, for example, whether a driver has been late to work recently, has left work early, has been working overtime, has received a dock in pay, or if the driver takes an unexpected leave, or if the driver has self-reported family issues such as a recent divorce or a death in the family (e.g., as may be reported to HR personnel). Each of these indicators can be taken as potential concern for the driver's health, which the driver health module 136 can analyze for potential a remediation recommendation to HR personnel. At block 404, the driver data is input by the driver health module 136 into a predictive model. The predictive model can analyze the driver data to determine whether to recommend for a supervisor to initiate remediation. For instance, the predictive model implemented by the driver health module 136 can search for events, a single instance of which may indicate that remediation may be desirable, or multiple of which or a pattern of which may suggest remediation. For instance, if a driver is in an accident or if a driver is in a near-accident then, for example, an instance evidenced by hard-braking and perhaps even skidding as detected by acceleration sensors or the like. The predictive model may recommend remediation.

In more complex scenarios, the predictive model can analyze a plurality of different factors, and based on detecting a pattern in those factors, can then recommend remediation. As an example, in the aggressive-driving example above, if a driver has recently started speeding 10% more than usual, has also begun hard-braking, and has shown up late to work, the predictive model may recommend remediation. At block 406, the driver health module 136 determines whether remediation is recommended by the model and, if so, outputs the remediation recommendation to a supervisor of the driver at block 408. Otherwise, the process 400 ends.

The driver health module 136 can update the predictive model based on input from HR personnel in a variety of driver situations. For instance, HR personnel can input whether the HR personnel agree or disagree with the recommendation, and the driver health module 136 can use this input to improve the predictive model. If a particular remediation recommendation is deemed useful or correct by a supervisor, for instance, the driver health module 136 can emphasize driver health factors leading to this recommendation. Conversely, if a supervisor inputs disagreement with a remediation recommendation, the driver health module 136 can deemphasize driver health factors leading to the recommendation. This remediation feedback from supervisors can provide crowd-sourcing benefits for predicting driver health situations that may benefit from remediation.

Moreover, in some embodiments, the predictive health model implemented by the driver health module 136 can be a neural network model or the like. Accordingly, the various driver health factors can be associated with weights in an electronic data store, such that a weighted sum of contributing driver health factors in any given scenario can be calculated to produce a predictive outcome of recommended mediation or no remediation. The weights can be initially obtained using a training data set and can be updated over time based on the supervisor feedback described above. The driver health module 136 can implement other algorithms, such as linear regression algorithms, instead of or in addition to neural network algorithms in various embodiments.

In one embodiment, the driver health module 136 outputs the remediation recommendation as a message to a supervisor. In another embodiment, the driver health module 136 outputs a more detailed recommendation of the specific type of remediation, for example, recommending additional training or counseling for a driver or easier routes for a driver that are perhaps shorter or that cover less distance or that are on less-rough roads, working fewer hours or time off, or that perhaps a driver could benefit from a small raise or recognition in the company for some achievement that the driver has made, or any combination of the above. These particular recommendations may be tied to specific types of behavior. For instance, if the driver is driving very aggressively, the driver health module 136 can recommend that the driver take some time off, etc. Alternatively, the driver health module 136 can recommend that remediation occur generically and leave the specific determination of what remediation to take to the supervisor.

In the aggregate, the process 400 can be used to ascertain some indication of the morale or pulse of a company, including a fleet of vehicles and their drivers, and can reflect whether a change in policy or other stressor is affecting drivers. The driver health module 136 can compute a fleet health score or company health score that reflects a combined (e.g., average) driver health rating for some or all drivers in an organization. Supervisors may find such a score useful in establishing HR policies.

VI. Example Community Diagnostics User Interfaces

Figure 5:
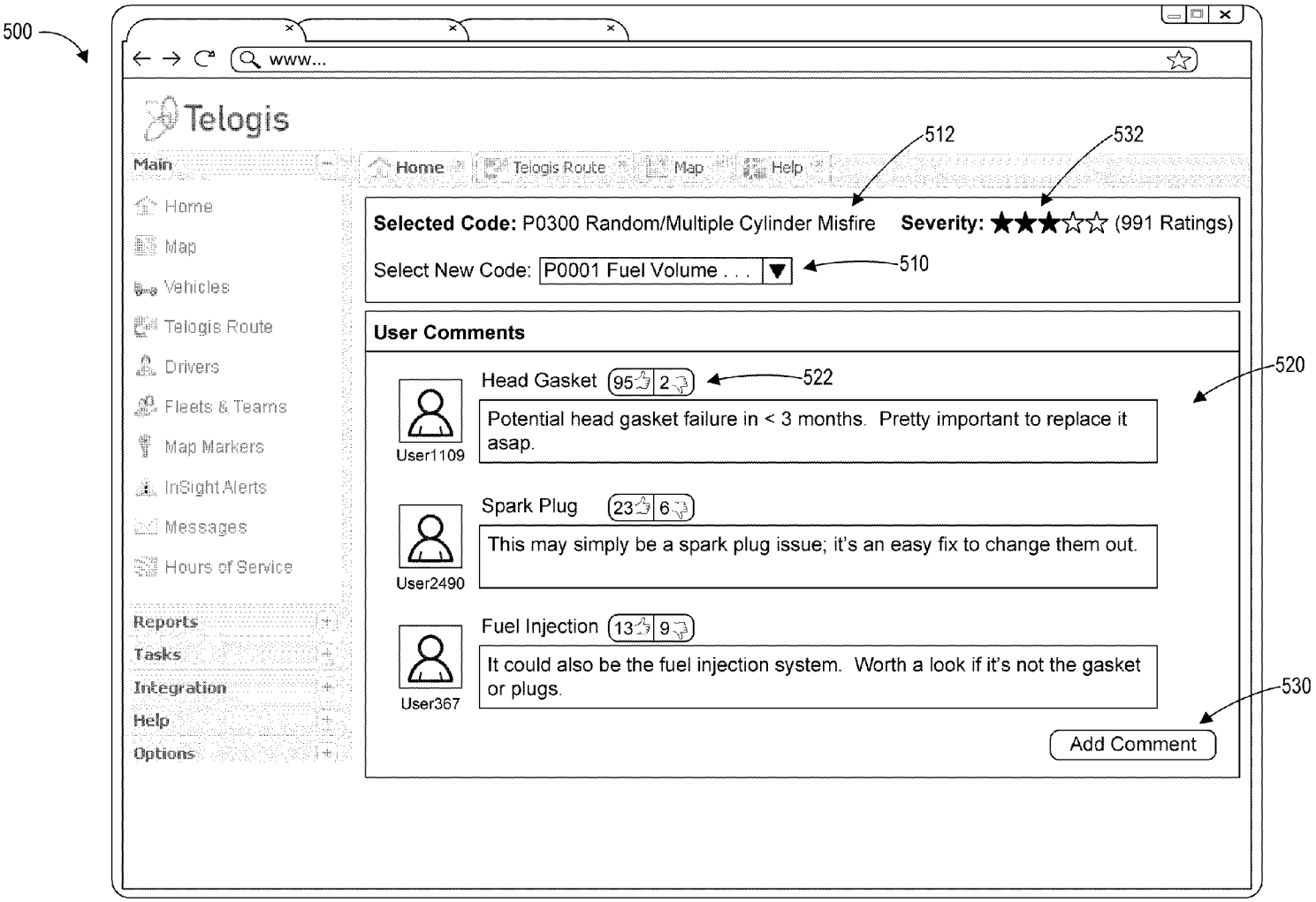
FIG. 5 depicts an embodiment of a community diagnostics user interface.

Turning to FIG. 5, an embodiment of a community diagnostics user interface 500 is shown. The user interface 500 can be output by the community diagnostics module 132. As shown in the depicted embodiment, the user interface 500 is implemented in a web browser. Although the user interface 500 is shown in a web browser, it could also be implemented by other applications, including mobile applications on mobile devices. In the user interface 500, a drop-down box 510 is shown that enables a user to select a DTC code. Upon selection of a DTC, the user interface 500 can output user comments 520 that correspond to the DTC. Users can select DTCs using the drop-down box 510 and then insert their own comments under the user comment section 520 or simply read comments from other users.

The comment section 520 include user comments about what vehicle problems users think the DTC might indicate. For instance, one user's comment in the comment section 520 indicates that this particular selected code 512 may be indicative of a head-gasket failure and that it is important to replace that head gasket as soon as possible. In addition, as shown, ratings 522 can be provided by users. The ratings 522 are shown in the form of up-or-down ratings in the depicted embodiment, such that a user can select thumbs up or thumbs down to indicate agreement or disagreement respectively with the user comment 520. Users can rate other user's comments, and the community diagnostics module 132 (or a user) can sort the comments based on the ratings to see which comments 520 are most likely relevant for the particular selected DTC. The ratings can enable users to filter the crowd-sourced information to obtain potential solutions to vehicle problems. A button in 530 is also added for adding a comment in the user interface 500.

In addition, a severity score or rating 532 is also presented that indicates what users think the severity of the selected code 512 is. In the depicted embodiment, the severity rating 532 is a 5-star rating and indicates that 991 users have rated the severity of this particular DTC. The rating shown reflects the average of several users' ratings.

Although buttons, drop-down boxes and various other user-interface controls are shown in the user interface 500, these controls are merely examples and can be varied to include other controls such as checkboxes, radio buttons, text boxes, combinations of the same and the like.

Figure 6:
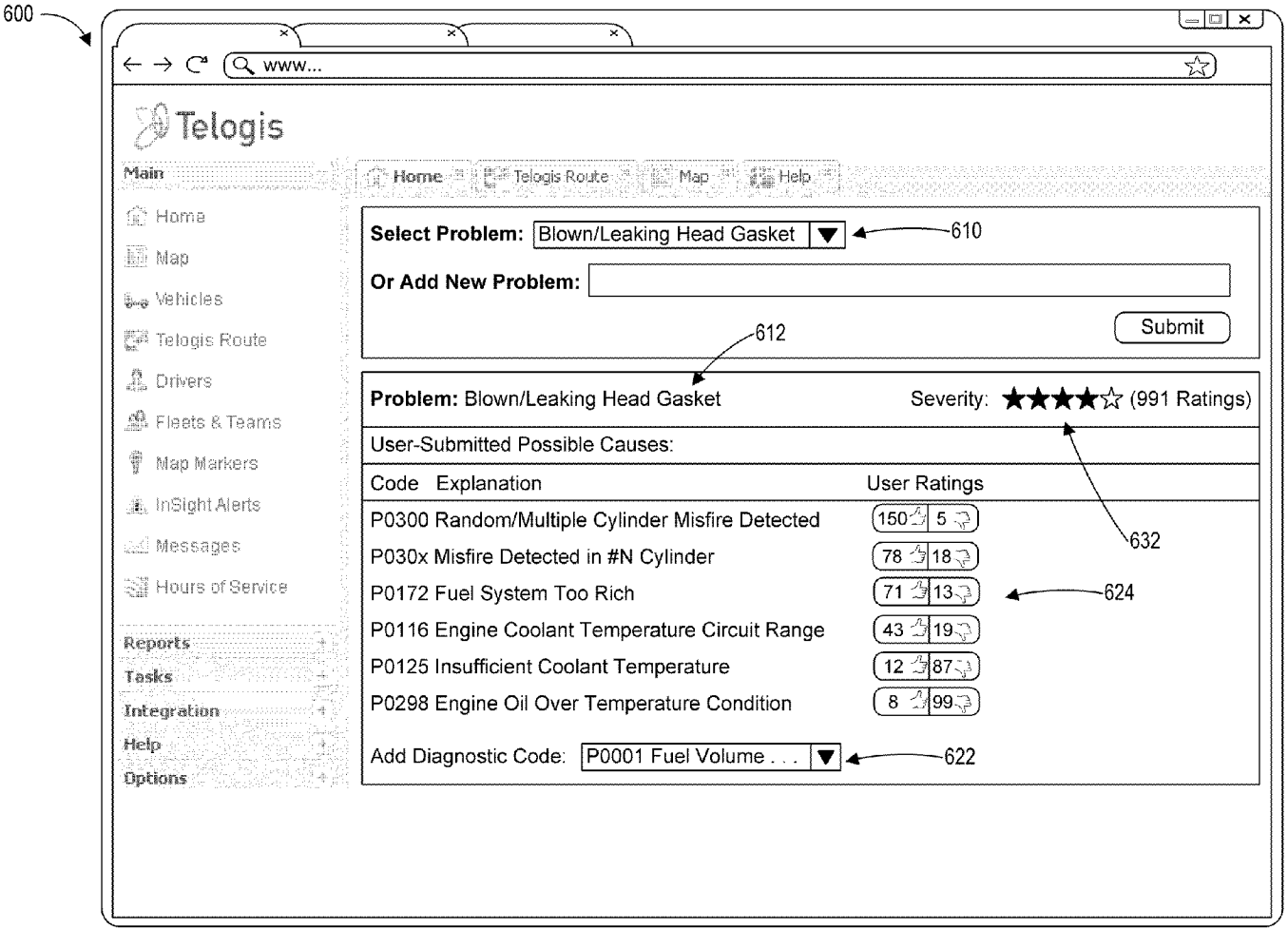
FIG. 6 depicts another embodiment of a community diagnostics user interface.

Turning to FIG. 6, another embodiment of the user interface 600 is shown. The user interface 600 may also be implemented by the community diagnostics module 132 and is shown as a web page, although the user interface 600 may also be implemented in any other application including a mobile application on a mobile device. The user interface 600 shows inverse functionality of the user interface 500. In particular, the user interface 500 allows a user to select a problem with drop-down box 610 and see corresponding DTCs 620 the users have associated with the selected problem in the drop-down box 610.

Another drop-down box 622 is provided in the user interface 600 that enables users to add a diagnostic code and associate it with a selected problem in the drop-down box 610. User ratings 624 enable a user to rate how likely the associated diagnostic code is to occur with the selected problem. These ratings are up-or-down ratings, although any form of rating system may be used. Likewise, severity ratings 632 are also provided in the form of 5-star ratings that users can select to estimate the severity of the selected problem 612.

Although buttons, drop-down boxes and various other user-interface controls are shown in the user interface 600, these controls are merely examples and can be varied to include other controls such as checkboxes, radio buttons, text boxes, combinations of same and the like.

VII. Further Embodiments

The vehicle management system 110 can include a number of features that enable fleets of vehicles or mobile units to be managed in a dynamic environment. Fleets of vehicles can be used to make deliveries, to support service calls, and to move personnel from place to place. Delivery vehicles typically take on a load from a depot and make deliveries to a number of customers in a limited region. Long distance deliveries are typically handled by long haul trucks of various types. They are typically point-to-point over hundreds of miles and may have a single destination or multiple destinations. Single destination deliveries may include containers that are offloaded from ocean based shipping vessels or from factories to depots or loading docks. Short distance delivery vehicles can have multiple destination loads. The loads can be assembled at a warehousing depot and delivered to customers or outlets in a series of multiple stops. Service call applications can be short haul multiple-stop, with variable 'dwell' times. Service may involve providing inventory or parts as well as service labor which may be performed by one or more people. Typical service calls (stops) can be made to perform maintenance and supply disposable inventory.

The characteristics of these types of fleet applications can be summarized as a list with each variable annotated in time, such as the following Data Vector List that may be stored in a database or other data store: [Vehicle, location, driver, depot, inventory list, delivery stop list, vehicle fuel, vehicle capacity, vehicle condition, route and schedule, loading time, stop and delivery time for each scheduled stop, status (e.g., not started, route in process, at service stop, route completed, stopped at terminal)]. The timeline can include the temporal state or condition associated with a single vehicle. Note that each of the variables could have an extended time history. For example, the inventory could have a time history associated with its ('time of conception, birth, ageing, and death'). So the current span of the state can be a 'window' of the total variable state.

The main fleet dependent characteristics can include the vehicle ID and the vehicle location, for example, as a function of time. When the vehicle is manufactured, ('comes into being'), its ID (e.g., serial number) may be known. When it becomes part of a fleet, its 'entry' can be recorded as a date, and it may be assigned other types of identifying characteristics including a license number/registration etc. From this 'vector of temporal existence', one can trace the complete history of a vehicle including fueling, speed, diagnostic information, drivers who have driven the vehicle, etc. In a similar fashion, history vectors of where the vehicle has been, its inventory, etc. may be kept and added to during the interval that the inventory, driver, tires, etc. are associated with the vehicle.

Telematics data, optionally supplemented by other data, can be used describe the history and to manage a single vehicle or multiple vehicles. By accessing some or all of the 'data vectors', a comprehensive tracking and management system for assets (including, e.g., vehicles, loads, maintenance), personnel, and/or inventory can developed. In addition to recommended (scheduled) maintenance based on time and miles travelled, maintenance can also be based on additional information such as frequent hard braking, number of stops/starts, etc. In one embodiment, the vehicle management system 110 can generate a maintenance plan that is based on normal scheduled maintenance and additionally includes maintenance that is based on analyzing multiple vehicle records over time. These records can be used to project cause-effect events which lead to a necessary but non-scheduled maintenance event.

Figure 7:
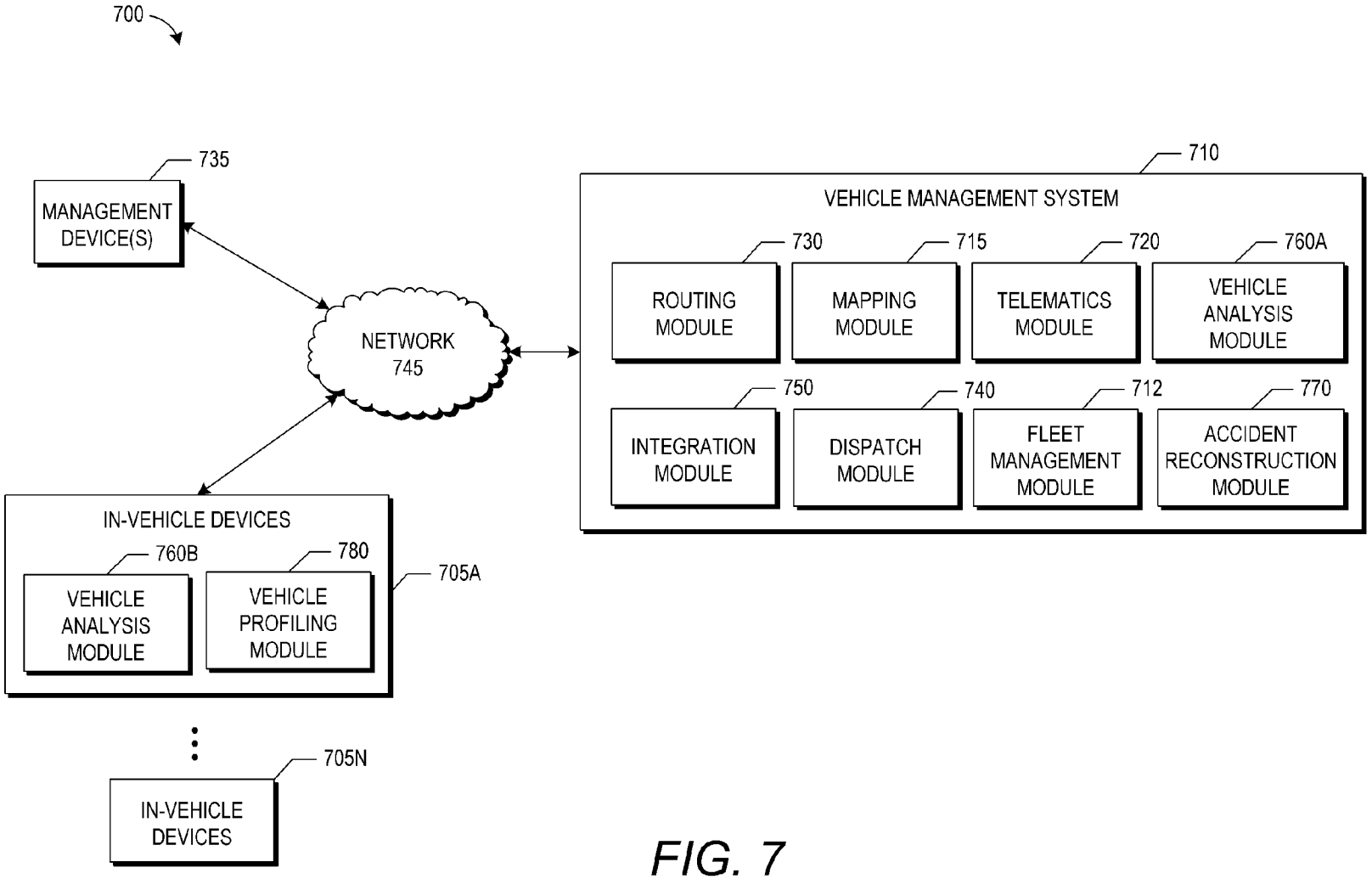
FIG. 7 illustrates an embodiment of a computing environment that includes an example vehicle management system.

FIG. 7 illustrates a computing environment 700 for implementing an example of a vehicle management system 710. The example vehicle management system 710 shown includes a vehicle analysis module 760 that can perform diagnostic and/or prognostic analysis of the engine and vehicle. The vehicle analysis module 760 can be implemented by one or more physical computing devices, examples of which are provided below. The vehicle analysis module 760 can be configured to perform onboard and/or offboard vehicle analysis and may be implemented in the system 710 (as offboard module 760A) and/or in the vehicles (as onboard module 760B). The onboard vehicle analysis module 760B optionally included in the vehicle can include one or more computers coupled to the vehicle computer. For example, in one embodiment the onboard vehicle analysis module 760B is a computing device or gateway device coupled to the vehicle computer through the OBDII port or CAN bus. The computing device can also be in communication with a radio device that transmits data from the computing device to the vehicle management system 710 or to other devices.

The vehicle analysis module 760A or 760B can collect and gather data and information about the engine from the vehicle computer and/or data from other sensors in or on the vehicle. The onboard vehicle analysis module 760B can communicate the collected vehicle data and information to the vehicle management system 710. In another embodiment, the onboard vehicle analysis module 760B filters or processes the data prior to sending the data to the vehicle management system 710. The onboard vehicle analysis module 760B can communicate some or all of the filtered data and information to the offboard vehicle analysis module 760A of the vehicle management system 710.

If the onboard vehicle analysis module 760B is unable to connect to a network or communicate with the vehicle management system 710, the onboard vehicle analysis module 760B can save and send the vehicle data when the onboard vehicle analysis module 760B is able to communicate with the server again. In some embodiments, the vehicle analysis module 760 can operatively couple with a mobile communication device located within the vehicle, such as a cell phone or other in-vehicle network capable electronic device. Vehicle diagnostic processes can be performed by the onboard vehicle analysis module 760B. The vehicle diagnostic processes can also be performed by the offboard vehicle analysis module 760A. In some embodiments, an initial analysis is performed by the onboard vehicle analysis module 760B and further analysis is performed by the offboard vehicle analysis module 760A.

The vehicle data collected by the onboard vehicle analysis module 160B can include vehicle condition information and engine data, such as vehicle year, make, model, engine/drive train, mileage, engine hours, start cycles, and other information related to vehicle condition. The vehicle data can also include check engine lights, fault codes, DTC codes, engine events, service intervals and other data collected from the engine computer. As mentioned above, the vehicle data collected by the onboard vehicle analysis module 760B can also include sensor data obtained from other sensors in the vehicle, such as tire pressure sensors, accelerometers, gyroscopes, temperature sensors, driver identification sensors (e.g., that communicate with an ID badge of a driver via RFID or the like), combinations of the same, or the like.

In the computing environment 700, one or more in-vehicle devices 705A . . . 705N and management devices 735 communicate with the vehicle management system 710 over a network 745. The in-vehicle devices 705A . . . 705N can include computing devices installed in fleet vehicles. These devices 705A . . . 705N can include navigation functionality, routing functionality, and the like. The in-vehicle devices 705A . . . 705N can receive route information and other information from the vehicle management system 710. In addition, the in-vehicle devices 705A . . . 705N can report information to the vehicle management system 710, such as driver location, vehicle sensor data, vehicle status (e.g., maintenance, tire pressure, or the like), and so forth. The in-vehicle device 705A can include a vehicle profiling module 780.

The vehicle management system 710 can be implemented by one or more physical computing devices, such as servers. These servers can be physically co-located or can be geographically separate, for example, in different data centers. In one embodiment, the vehicle management system 710 is implemented as a cloud computing application. For instance, the vehicle management system 710 can be a cloud-implemented platform hosted in one or more virtual servers and/or physical servers accessible to users over the Internet or other network 745. In the depicted embodiment, the vehicle management system 710 includes a fleet management module 712, a mapping module 715, a telematics module 720, a routing module 730, a dispatch module 740, and an integration module 750. These components can, but need not, be integrated together on a common software or hardware platform.

The vehicle management system 710 can also include an accident reconstruction module 770. The accident reconstruction module 770 can be used after a vehicle has been in an accident to reconstruct the accident. The accident reconstruction module 770 can use in-vehicle cameras and sensors to reconstruct the accident. The module 770 can also provide the vehicle management system 710 real-time notification and remote access to the in-vehicle sensors and equipment. For example, the vehicle can include multiple cameras that capture data during operation, such as a back-up camera, an in-vehicle driver camera (captures drivers actions), a forward facing camera, side-view cameras, and other cameras that capture operation of the vehicle. The cameras and sensors can communicate and/or stream data back to the accident construction module 770 in real-time. The module 770 can also use engine information such as vehicle, speed, acceleration, braking, and other information to help reconstruct the accident.

VIII. Additional Embodiments

As described above with respect to FIG. 2, the community diagnostics module 132 can receive DTCs and vehicle sensor data directly from the telematics data. In other embodiments, a service technician or other worker can input DTCs and/or other vehicle sensor data manually into a user interface provided by the community diagnostics module 132. In the process of servicing the vehicle, the service technician may identify a problem with the vehicle and also input a description of this problem in the user interface. The community diagnostics module 132 can programmatically link the service technician's description of the problem with the DTC(s) and/or other vehicle sensor data.

As a plurality of service technicians input this data, the community diagnostics module 132 can build a database of community prognostics data for DTCs and/or other vehicle sensor data. This community prognostics data can be accessed as described above, e.g., in the process of FIG. 2, to subsequently diagnose a vehicle condition based on receiving an input of a DTC associated with the vehicle. Further, a user interface can output this diagnostic information, and the service technician can input his or her comments in response (such as agreement, disagreement, proposing a new condition to associated with the DTC/sensor data, etc.). This user interface can include any of the features of the user interfaces described elsewhere herein.

IX. Terminology

A number of computing systems have been described throughout this disclosure. The descriptions of these systems are not intended to limit the teachings or applicability of this disclosure. For example, the user systems described herein can generally include any computing device(s), such as desktops, laptops, video game platforms, television set-top boxes, televisions (e.g., internet TVs), computerized appliances, and wireless mobile devices (e.g. smart phones, PDAs, tablets, or the like), to name a few. Further, it is possible for the user systems described herein to be different types of devices, to include different applications, or to otherwise be configured differently. In addition, the user systems described herein can include any type of operating system ("OS"). For example, the mobile computing systems described herein can implement an Android™ OS, a Windows® OS, a Mac® OS, a Linux or Unix-based OS, or the like.

Further, the processing of the various components of the illustrated systems can be distributed across multiple machines, networks, and other computing resources. In addition, two or more components of a system can be combined into fewer components. For example, the various systems described herein can be distributed across multiple computing systems, or combined into a single computing system. Further, various components of the illustrated systems can be implemented in one or more virtual machines, rather than in dedicated computer hardware systems. Likewise, the data repositories shown can represent physical and/or logical data storage, including, for example, storage area networks or other distributed storage systems. Moreover, in some embodiments the connections between the components shown represent possible paths of data flow, rather than actual connections between hardware. While some examples of possible connections are shown, any of the subset of the components shown can communicate with any other subset of components in various implementations.

Depending on the embodiment, certain acts, events, or functions of any of the algorithms, methods, or processes described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially.

Each of the various illustrated systems may be implemented as a computing system that is programmed or configured to perform the various functions described herein. The computing system may include multiple distinct computers or computing devices (e.g., physical servers, workstations, storage arrays, etc.) that communicate and interoperate over a network to perform the described functions. Each such computing device typically includes a processor (or multiple processors) that executes program instructions or modules stored in a memory or other non-transitory computer-readable storage medium. The various functions disclosed herein may be embodied in such program instructions, although some or all of the disclosed functions may alternatively be implemented in application-specific circuitry (e.g., ASICs or FPGAs) of the computer system. Where the computing system includes multiple computing devices, these devices may, but need not, be co-located. The results of the disclosed methods and tasks may be persistently stored by transforming physical storage devices, such as solid state memory chips and/or magnetic disks, into a different state. Each process described may be implemented by one or more computing devices, such as one or more physical servers programmed with associated server code.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

While the above detailed description has shown, described, and pointed out novel features as applied to various embodiments, it will be understood that various omissions, substitutions, and changes in the form and details of the devices or algorithms illustrated can be made without departing from the spirit of the disclosure. Thus, nothing in the foregoing description is intended to imply that any particular feature, characteristic, step, module, or block is necessary or indispensable. As will be recognized, the processes described herein can be embodied within a form that does not provide all of the features and benefits set forth herein, as some features can be used or practiced separately from others. The scope of protection is defined by the appended claims rather than by the foregoing description.

What is claimed is:

1. A method of programmatically diagnosing vehicle problems, the method comprising:

under control of a hardware processor:

outputting a user interface configured to provide functionality for a plurality of users to:

associate, using a first interface element of the user interface, individual diagnostic trouble codes of a plurality of diagnostic trouble codes with (i) individual sensor parameters of a plurality of sensor parameters and (ii) individual predicted diagnoses of a plurality of predicted diagnoses, the plurality of diagnostic trouble codes being indicative of one or more fault conditions in vehicles of a vehicle fleet, rate, using a second interface element of the user interface, the association between the individual diagnostic trouble codes of the plurality of diagnostic trouble codes, the individual sensor parameters of the plurality of sensor parameters, and the individual predicted diagnoses of the plurality of predicted diagnoses, and provide, using a third interface element of the user interface, comments in connection with the association between the individual diagnostic trouble codes of the plurality of diagnostic trouble codes, the individual sensor parameters of the plurality of sensor parameters, and the individual predicted diagnoses of the plurality of predicted diagnoses;

storing, in a memory, the association, received from the plurality of users via user input to the first interface element, between the individual diagnostic trouble codes of the plurality of diagnostic trouble codes, the individual sensor parameters of the plurality of sensor parameters, and the individual predicted diagnoses of the plurality of predicted diagnoses, the rating, received from the plurality of users via user input to the second interface element, of the association between the individual diagnostic trouble codes of the plurality of diagnostic trouble codes, the individual sensor parameters of the plurality of sensor parameters, and the individual predicted diagnoses of the plurality of predicted diagnoses, and the comments, received from the plurality of users via user input to the third interface element, in connection with the association between the individual diagnostic trouble codes of the plurality of diagnostic trouble codes, the individual sensor parameters of the plurality of sensor parameters, and the individual predicted diagnoses of the plurality of predicted diagnoses;

programmatically identifying, from telematics data associated with a first vehicle of the vehicles, a first diagnostic trouble code of the plurality of diagnostic trouble codes output by the first vehicle and a first sensor parameter of the plurality of sensor parameters determined for the first vehicle, the first sensor parameter comprising one or more of a temperature measurement, a rotation force measurement, an odometer reading, a blown-out tire sensor reading, and a tire pressure reading;

accessing, from the memory, the associations between the first diagnostic trouble code and the first sensor parameter;

programmatically identifying, based at least on the rating of the associations between the first diagnostic trouble code and the first sensor parameter, a first predicted diagnosis of the plurality of predicted diagnoses associated with the first diagnostic trouble code and the first sensor parameter; and outputting, for presentation on a display to a user of the plurality of users, the first predicted diagnosis and at least some of the comments provided in connection with the association between the first diagnostic trouble code, the first sensor parameter, and the first predicted diagnosis.

2. The method of claim 1, wherein said programmatically identifying the first diagnostic trouble code and the first sensor parameter is performed substantially in real time with receiving the telematics data from the first vehicle.

3. Non-transitory physical computer storage comprising instructions stored therein that, when executed by a hardware processor, are configured to perform operations for programmatically diagnosing vehicle problems, the operations comprising:

outputting a user interface configured to provide functionality for a plurality of users to:

associate, using a first interface element of the user interface, individual diagnostic trouble codes of a plurality of diagnostic trouble codes with (i) individual sensor parameters of a plurality of sensor parameters and (ii) individual predicted diagnoses of a plurality of predicted diagnoses, the plurality of diagnostic trouble codes being indicative of one or more fault conditions in vehicles of a vehicle fleet, rate, using a second interface element of the user interface, the association between the individual diagnostic trouble codes of the plurality of diagnostic trouble codes, the individual sensor parameters of the plurality of sensor parameters, and the individual predicted diagnoses of the plurality of predicted diagnoses, and provide, using a third interface element of the user interface, comments in connection with the association between the individual diagnostic trouble codes of the plurality of diagnostic trouble codes, the individual sensor parameters of the plurality of sensor parameters, and the individual predicted diagnoses of the plurality of predicted diagnoses;

storing, in a memory, the association, received from the plurality of users via user input to the first interface element, between the individual diagnostic trouble codes of the plurality of diagnostic trouble codes, the individual sensor parameters of the plurality of sensor parameters, and the individual predicted diagnoses of the plurality of predicted diagnoses, the rating, received from the plurality of users via user input to the second interface element, of the association between the individual diagnostic trouble codes of the plurality of diagnostic trouble codes, the individual sensor parameters of the plurality of sensor parameters, and the individual predicted diagnoses of the plurality of predicted diagnoses, and the comments, received from the plurality of users via user input to the third interface element, provided in connection with the association between the individual diagnostic trouble codes of the plurality of diagnostic trouble codes, the individual sensor parameters of the plurality of sensor parameters, and the individual predicted diagnoses of the plurality of predicted diagnoses;

programmatically identifying, from telematics data associated with a first vehicle of the vehicles, a first diagnostic trouble code of the plurality of diagnostic trouble codes output by the first vehicle and a first sensor parameter of the plurality of sensor parameters determined for the first vehicle, the first sensor parameter comprising one or more of a temperature measurement, a rotation force measurement, an odometer reading, a blown-out tire sensor reading, and a tire pressure reading;

accessing, from the memory, the associations between the first diagnostic trouble code and the first sensor parameter;

programmatically identifying, based at least on the rating of the associations between the first diagnostic trouble code and the first sensor parameter, a first predicted diagnosis of the plurality of predicted diagnoses associated with the first diagnostic trouble code and the first sensor parameter; and outputting, for presentation on a display to a user of the plurality of users, the first predicted diagnosis and at least some of the comments provided in connection with the association between the first diagnostic trouble code, the first sensor parameter, and the first predicted diagnosis.

4. The non-transitory physical computer storage of claim 3, wherein said programmatically identifying the first diagnostic trouble code and the first sensor parameter is performed substantially in real time with receiving the telematics data from the first vehicle.

5. A system for programmatically diagnosing vehicle problems, the system comprising:

a hardware processor configured to:

output a user interface configured to provide functionality for a plurality of users to:

associate, using a first interface element of the user interface, individual diagnostic trouble codes of a plurality of diagnostic trouble codes with (i) individual sensor parameters of a plurality of sensor parameters and (ii) individual predicted diagnoses of a plurality of predicted diagnoses, the plurality of diagnostic trouble codes being indicative of one or more fault conditions in vehicles of a vehicle fleet, rate, using a second interface element of the user interface, the association between the individual diagnostic trouble codes of the plurality of diagnostic trouble codes, the individual sensor parameters of the plurality of sensor parameters, and the individual predicted diagnoses of the plurality of predicted diagnoses, and provide, using a third interface element of the user interface, comments in connection with the association between the individual diagnostic trouble codes of the plurality of diagnostic trouble codes, the individual sensor parameters of the plurality of sensor parameters, and the individual predicted diagnoses of the plurality of predicted diagnoses;

store, in a memory, the association, received from the plurality of users via user input to the first interface element, between the individual diagnostic trouble codes of the plurality of diagnostic trouble codes, the individual sensor parameters of the plurality of sensor parameters, and the individual predicted diagnoses of the plurality of predicted diagnoses, the rating, received from the plurality of users via user input to the second interface element, of the association between the individual diagnostic trouble codes of the plurality of diagnostic trouble codes, the individual sensor parameters of the plurality of sensor parameters, and the individual predicted diagnoses of the plurality of predicted diagnoses, and the comments, received from the plurality of users via user input to the third interface element, provided in connection with the association between the individual diagnostic trouble codes of the plurality of diagnostic trouble codes, the individual sensor parameters of the plurality of sensor parameters, and the individual predicted diagnoses of the plurality of predicted diagnoses;

programmatically identify, from telematics data associated with a first vehicle of the vehicles, a first diagnostic trouble code of the plurality of diagnostic trouble codes output by the first vehicle and a first sensor parameter of the plurality of sensor parameters determined for the first vehicle, the first sensor parameter comprising one or more of a temperature measurement, a rotation force measurement, an odometer reading, a blown-out tire sensor reading, and a tire pressure reading;

access, from the memory, the associations between the first diagnostic trouble code and the first sensor parameter;

programmatically identify, based at least on the rating of the associations between the first diagnostic trouble code and the first sensor parameter, a first predicted diagnosis of the plurality of predicted diagnoses associated with the first diagnostic trouble code and the first sensor parameter; and output, for presentation on a display to a user of the plurality of users, the first predicted diagnosis and at least some of the comments provided in connection with the association between the first diagnostic trouble code, the first sensor parameter, and the first predicted diagnosis.

6. The system of claim 5, wherein the processor is further configured to programmatically identify the first diagnostic trouble code and the first sensor parameter substantially in real time with receiving the telematics data from the first vehicle.

7. The non-transitory physical computer storage of claim 3, wherein said accessing is performed in response to said programmatically identifying the first diagnostic trouble code and the first sensor parameter.

8. The non-transitory physical computer storage of claim 3, wherein the operations further comprise programmatically identifying, based at least on the rating of the associations between the first diagnostic trouble code and the first sensor parameter, a second predicted diagnosis of the plurality of predicted diagnoses associated with the first diagnostic trouble code and the first sensor parameter, and wherein said outputting comprises outputting, for presentation on the display to the user, the second predicted diagnosis together with the first predicted diagnosis and the at least some of the comments provided in connection with the association between the first diagnostic trouble code, the first sensor parameter, and the first predicted diagnosis.

9. The non-transitory physical computer storage of claim 3, wherein the operations further comprise programmatically identifying, based at least on the rating of the associations between the first diagnostic trouble code and the first sensor parameter, a second predicted diagnosis of the plurality of predicted diagnoses associated with the first diagnostic trouble code and the first sensor parameter, and wherein said outputting comprises outputting, for presentation on the display to the user, the first predicted diagnosis and the second predicted diagnosis so that a display arrangement of the first predicted diagnosis and the second predicted diagnosis on the display depends at least on the rating of the associations between the first diagnostic trouble code and the first sensor parameter.

10. The non-transitory physical computer storage of claim 3, wherein the user interface is configured to provide functionality for the plurality of users to indicate, using a fourth interface element of the user interface, a severity rating associated with the first predicted diagnosis, and wherein said outputting comprises outputting, for presentation on the display to the user, the severity rating together with the first predicted diagnosis and the at least some of the comments provided in connection with the association between the first diagnostic trouble code, the first sensor parameter, and the first predicted diagnosis.

11. The non-transitory physical computer storage of claim 3, wherein the user interface is configured to provide functionality for the plurality of users to indicate, using a fourth interface element of the user interface, a severity rating associated with the first diagnostic trouble code, and wherein said outputting comprises outputting, for presentation on the display to the user, the severity rating together with the first predicted diagnosis and the at least some of the comments provided in connection with the association between the first diagnostic trouble code, the first sensor parameter, and the first predicted diagnosis.

12. The non-transitory physical computer storage of claim 3, wherein the first sensor parameter comprises the temperature measurement.

13. The non-transitory physical computer storage of claim 3, wherein the first sensor parameter comprises the rotation force measurement.

14. The non-transitory physical computer storage of claim 3, wherein the first sensor parameter comprises the odometer reading.

15. The non-transitory physical computer storage of claim 3, wherein the first sensor parameter comprises the blown-out tire sensor reading.

16. The non-transitory physical computer storage of claim 3, wherein the first sensor parameter comprises the tire pressure reading.

17. The system of claim 5, wherein the processor is further configured to access the associations between the first diagnostic trouble code and the first sensor parameter in response to programmatically identifying the first diagnostic trouble code and the first sensor parameter.

18. The system of claim 5, wherein the processor is further configured to:

programmatically identify, based at least on the rating of the associations between the first diagnostic trouble code and the first sensor parameter, a second predicted diagnosis of the plurality of predicted diagnoses associated with the first diagnostic trouble code and the first sensor parameter, and output, for presentation on the display to the user, the second predicted diagnosis together with the first predicted diagnosis and the at least some of the comments provided in connection with the association between the first diagnostic trouble code, the first sensor parameter, and the first predicted diagnosis.

19. The system of claim 5, wherein the processor is further configured to:

programmatically identify, based at least on the rating of the associations between the first diagnostic trouble code and the first sensor parameter, a second predicted diagnosis of the plurality of predicted diagnoses associated with the first diagnostic trouble code and the first sensor parameter, and output, for presentation on the display to the user, the first predicted diagnosis and the second predicted diagnosis so that a display arrangement of the first predicted diagnosis and the second predicted diagnosis on the display depends at least on the rating of the associations between the first diagnostic trouble code and the first sensor parameter.

20. The system of claim 5, wherein the first sensor parameter comprises the rotation force measurement.

21. The system of claim 5, in combination with an in-vehicle device associated with the first vehicle, the in-vehicle device being configured to:

receive vehicle data from an engine computer of the first vehicle or from sensors on or in the first vehicle;

filter the vehicle data to generate filtered vehicle data; and transmit the filtered vehicle data to the hardware processor for further processing.

* * * * *